US009514920B2

(12) United States Patent
Hattori et al.

(10) Patent No.: US 9,514,920 B2
(45) Date of Patent: Dec. 6, 2016

(54) ELECTRON MULTIPLIER BODY, PHOTOMULTIPLIER TUBE, AND PHOTOMULTIPLIER

(71) Applicant: HAMAMATSU PHOTONICS K.K., Hamamatsu-shi, Shizuoka (JP)

(72) Inventors: Shinya Hattori, Hamamatsu (JP); Motohiro Suyama, Hamamatsu (JP); Hiroshi Kobayashi, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 15/058,199

(22) Filed: Mar. 2, 2016

(65) Prior Publication Data

US 2016/0260593 A1 Sep. 8, 2016

(30) Foreign Application Priority Data

Mar. 3, 2015 (JP) ..... 2015-041556

(51) Int. Cl.
*H01J 43/04* (2006.01)
*H01J 43/16* (2006.01)

(52) U.S. Cl.
CPC ..... *H01J 43/16* (2013.01)

(58) Field of Classification Search
CPC ..... H01J 43/16
USPC ..... 313/532, 534
See application file for complete search history.

(56) References Cited

U.S. PATENT DOCUMENTS 3,244,922 A 4/1966 Wolfgang
3,374,380 A 3/1968 Goodrich
7,042,160 B2 5/2006 Hosea et al.

FOREIGN PATENT DOCUMENTS

JP 4762719 B2 8/2011

*Primary Examiner* — Vip Patel
(74) *Attorney, Agent, or Firm* — Drinker Biddle & Reath LLP

(57) ABSTRACT

An electron multiplier body including a main body portion, an electron incidence portion, and a channel, in which the channel includes a first inner surface and a second inner surface facing each other, the first inner surface includes a convex first bent portion and a concave second bent portion, and a plurality of first inclined surfaces, the second inner surface includes a convex third bent portion and a concave fourth bent portion, and a plurality of second inclined surfaces, and an interval between a tip of the first bent portion and a tip of the third bent portion, a distance between the first inclined surface and the second inclined surfaces facing each other, an angle between a pair of first inclined surfaces defining the first bent portion, and a length of the channel satisfy predetermined expressions.

5 Claims, 14 Drawing Sheets

ELECTRON MULTIPLIER BODY, PHOTOMULTIPLIER TUBE, AND PHOTOMULTIPLIER

TECHNICAL FIELD

An aspect of the present invention relates to an electron multiplier body, a photomultiplier tube, and a photomultiplier.

BACKGROUND

An electron multiplier body is described in U.S. Pat. No. 3,244,922. This electron multiplier body includes a wavy passage extending in a longitudinal direction of a rectangular parallelepiped block. A secondary electron emitting layer made of a semiconductor is provided on an inner surface of the passage.

SUMMARY

Meanwhile, the electron multiplier body as described above emits secondary electrons by causing electrons accelerated by a potential difference to collide with the inner surface of the passage. Here, in the electron multiplier body, the improvement of electron multiplication efficiency is desired. However, in the electron multiplier body described in Patent Document 1, a shape of the passage for improving electron multiplication efficiency is not considered at all.

An aspect of the present invention has been made in view of such circumstances, and an object thereof is to provide an electron multiplier body, a photomultiplier tube, and a photomultiplier capable of improving electron multiplication efficiency.

An electron multiplier body according to an aspect of the present invention includes: a main body portion extending in a first direction; an electron incidence portion provided in the main body portion to be opened at one end surface of the main body portion in the first direction, and on which electrons are incident from the outside of the main body portion; and a channel provided in the main body portion to be opened at the other end surface of the main body portion in the first direction and reach the electron incidence portion and configured to emit secondary electrons according to electrons incident from the electron incidence portion, wherein the channel includes a first inner surface and a second inner surface extending over the entire channel in the first direction and facing each other, the first inner surface includes a convex first bent portion and a concave second bent portion arranged alternately in the first direction, and a plurality of first inclined surfaces defining the first bent portion and the second bent portion, the second inner surface includes a convex third bent portion and a concave fourth bent portion arranged alternately in the first direction, and a plurality of second inclined surfaces defining the third bent portion and the fourth bent portion, the first bent portion and the fourth bent portion are arranged to face each other in a second direction directed from the first inner surface to the second inner surface, the second bent portion and the third bent portion are arranged to face each other in the second direction, and when an interval between a tip of the first bent portion and a tip of the third bent portion in the second direction is h, a distance between the first inclined surface and the second inclined surfaces facing each other is d, an angle between a pair of first inclined surfaces defining the first bent portion is θ, and a length of the channel in the first direction is L, Expressions (1) to (4) below are satisfied.

[Expression 1]

$$-0.5 \le h/d \le 0.5 \quad (1)$$

[Expression 2]

$$96° \le \theta \le 172° \quad (2)$$

[Expression 3]

$$0.1\ \text{mm} \le d \le 10\ \text{mm} \quad (3)$$

[Expression 4]

$$4.0\ \text{mm} \le L \le 400\ \text{mm} \quad (4)$$

In this electron multiplier body, the first inner surface of the channel includes the convex first bent portion and the concave second bent portion, and the first inclined surfaces defining the bent portions. The second inner surface of the channel includes the convex third bent portion and the concave fourth bent portion, and the second inclined surfaces defining the bent portions. Also, the first bent portion and the fourth bent portion face each other, and the second bent portion and the third bent portion face each other. By the inner surfaces of the channel having such a shape, electrons traveling inside the channel collide with the first inclined surface or the second inclined surface, such that the secondary electrons are emitted. The emitted secondary electrons travel to the downstream side in the first direction of the channel, and further collide with the second inclined surface or the first inclined surface. Accordingly, secondary electrons are further emitted. In this case, since respective values defining the shape of the channel satisfy Expressions (1) to (4) above, electron multiplication efficiency can be improved.

In the electron multiplier body according to an aspect of the present invention, Expression (5) below may be further satisfied. Here, even when a pressure inside the channel is reduced, there is residual gas in the channel. The residual gas causes ion feedback. That is, if electrons traveling inside the channel collide with the residual gas, ions may be generated from the residual gas. The ions generated from the residual gas travel inside the channel while being accelerated in a direction opposite to the first direction under the influence of a potential difference in the channel. If the ions collide with the inner surface of the channel or the like, unexpected electron emission may occur and noise may be generated in an output signal. On the other hand, it is possible to block a traveling path of the ions by adopting the above configuration. Therefore, it is possible to reduce an amount of electrons emitted by the ion feedback as described above. Therefore, it is possible to reduce the noise of the output signal.

[Expression 5]

$$h/d \le 0 \quad (5)$$

In the electron multiplier body according to an aspect of the present invention, each of the first bent portion and the second bent portion may connect a pair of first inclined surfaces in a curved surface, and each of the third bent portion and the fourth bent portion may connect a pair of second inclined surfaces in a curved surface. According to this configuration, it is possible to suppress the occurrence of a burr in the bent portion when the bent portion is formed. Further, even when the burr occurs when the bent portion is formed, the burr can be removed when the bent portion is processed in a curved shape. Therefore, it is possible to suppress electron emission and discharge which become noise caused by the burr in the bent portion. Accordingly, it is possible to reduce the noise of the output signal.

A photomultiplier tube according to an aspect of the present invention includes the electron multiplier body; a tube body accommodating the electron multiplier body; a photocathode provided in the tube body to face an opening of the electron incidence portion in the one end surface, and supplies photoelectrons to the electron incidence portion; and an anode arranged in the tube body to face the opening of the channel in the other end surface, and receives the secondary electrons.

This photomultiplier tube includes the above-described electron multiplier body. Therefore, it is possible to preferably achieve operations and effects by the electron multiplier body.

A photomultiplier according to an aspect of the present invention includes the electron multiplier body; a photocathode provided to close an opening of the electron incidence portion in the one end surface, and supplies photoelectrons to the electron incidence portion; and an anode provided to close the opening of the channel in the other end surface, and receives the secondary electrons.

The photomultiplier includes the above-described electron multiplier body. Therefore, it is possible to preferably achieve operations and effects by the electron multiplier body.

An electron multiplier body includes: a main body portion extending in a first direction; an electron incidence portion provided in the main body portion to be opened at one end surface of the main body portion in the first direction, and on which electrons are incident from the outside of the main body portion; and a channel provided in the main body portion to be opened at the other end surface of the main body portion in the first direction and reach the electron incidence portion, and configured to emit secondary electrons according to electrons incident from the electron incidence portion, wherein the channel includes a first inner surface and a second inner surface extending over the entire channel in the first direction and facing each other, the first inner surface includes a convex first bent portion and a concave second bent portion arranged alternately in the first direction, and a plurality of first inclined surfaces defining the first bent portion and the second bent portion, the second inner surface includes a convex third bent portion and a concave fourth bent portion arranged alternately in the first direction, and a plurality of second inclined surfaces defining the third bent portion and the fourth bent portion, the first bent portion and the fourth bent portion are arranged to face each other in a second direction directed from the first inner surface to the second inner surface, the second bent portion and the third bent portion are arranged to face each other in the second direction, and when an interval between a tip of the first bent portion and a tip of the third bent portion in the second direction is h, a distance between the first inclined surface and the second inclined surfaces facing each other is d, an angle between a pair of first inclined surfaces defining the first bent portion is θ, and a length of the channel in the first direction is L, Expressions (1), (3), (4), and (6) below are satisfied.

[Expression 6]

$$-0.5 \leq h/d \leq 0.5 \quad (1)$$

[Expression 7]

$$140° \leq \theta \leq 172° \quad (6)$$

[Expression 8]

$$0.1 \text{ mm} \leq d \leq 10 \text{ mm} \quad (3)$$

[Expression 9]

$$4.0 \text{ mm} \leq L \leq 400 \text{ mm} \quad (4)$$

According to an aspect of the present invention, it is possible to improve electron multiplication efficiency.

DETAILED DESCRIPTION

Hereinafter, an embodiment of the present invention will be described in detail with reference to the drawings. The same or corresponding portions in the respective drawings are denoted with the same reference signs, and repeated description is omitted.

Figure 1:
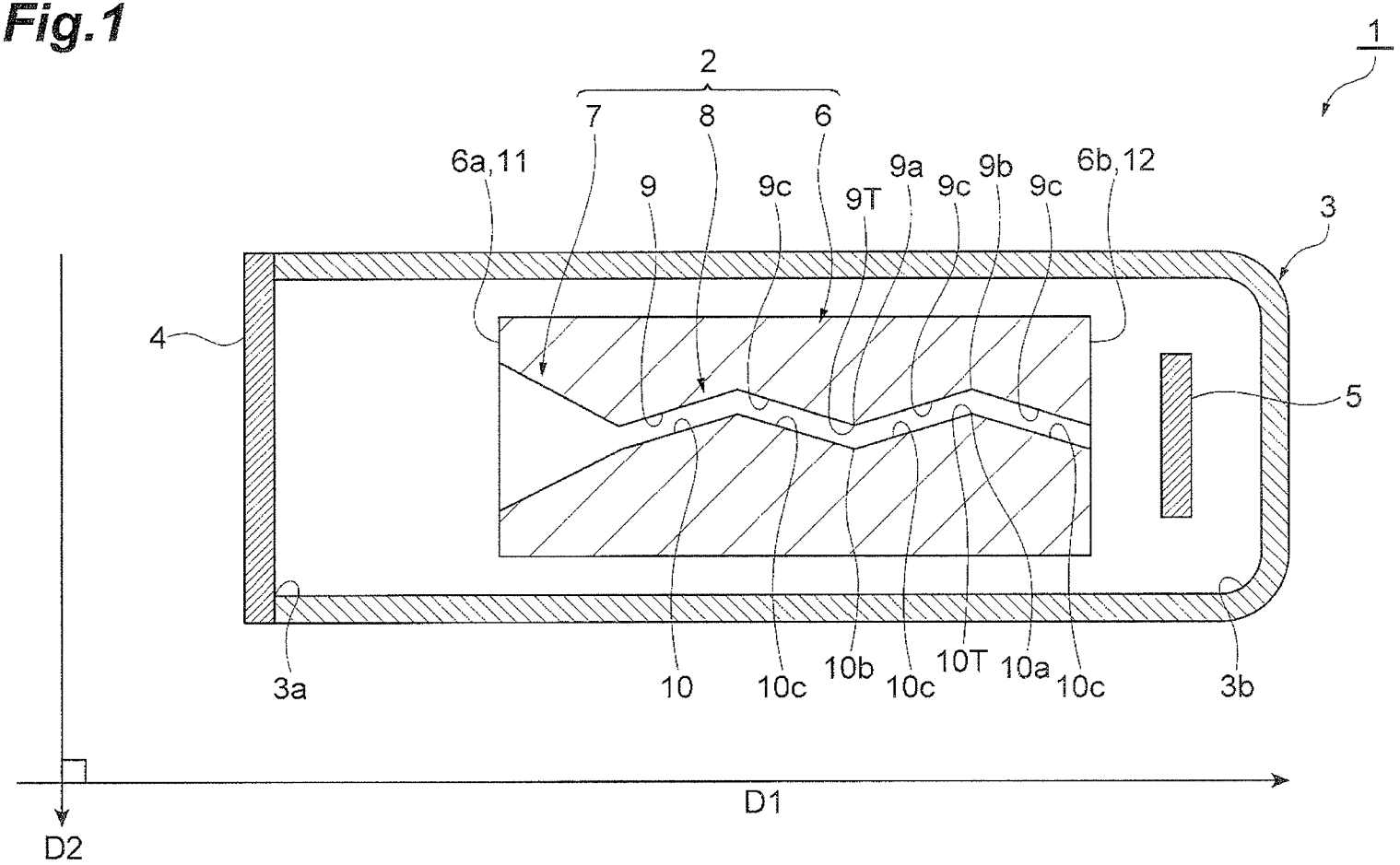
FIG. 1 is a cross-sectional view of a photomultiplier tube according to an embodiment of the present invention.
Figure 2:
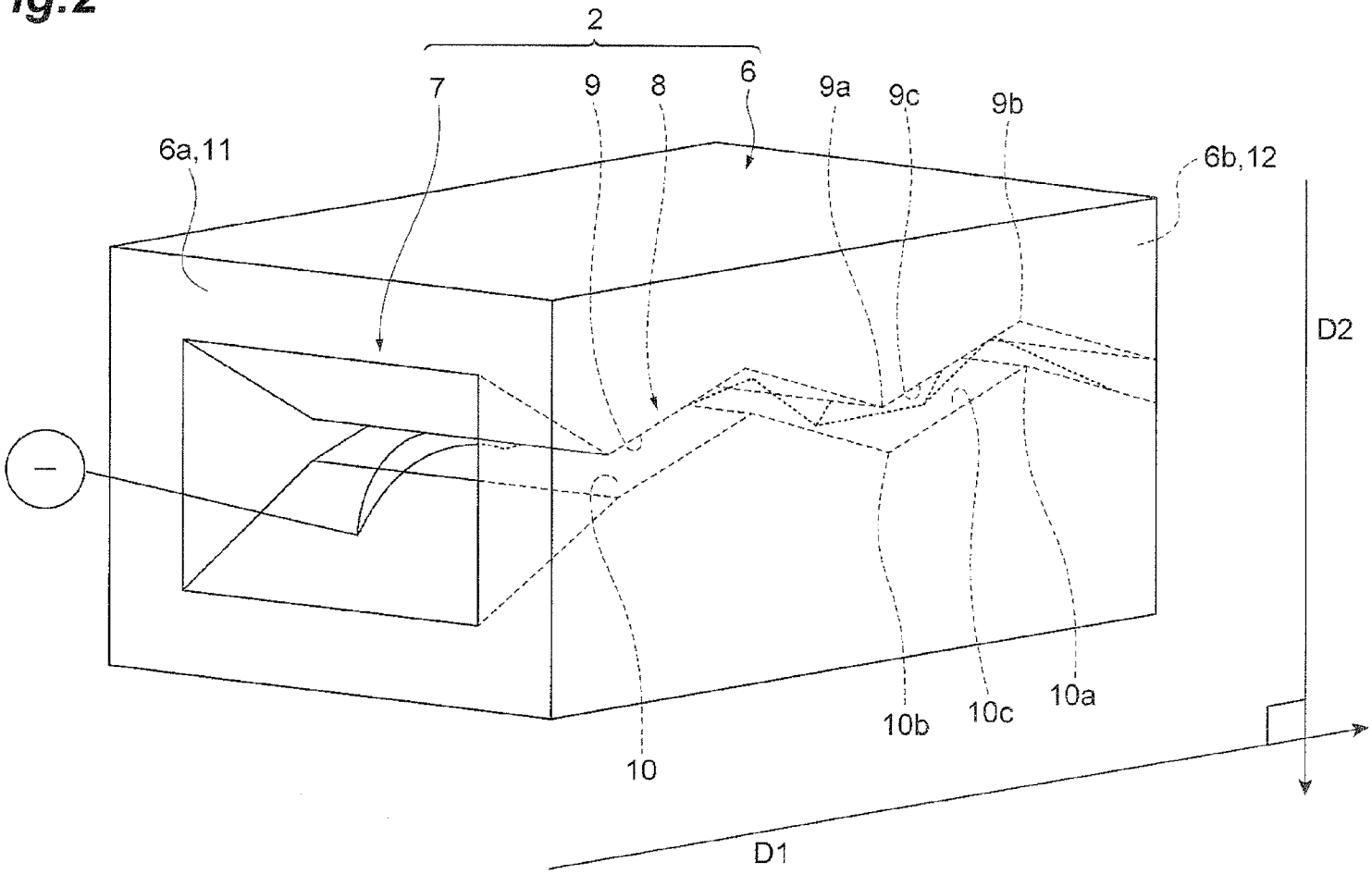
FIG. 2 is a perspective view of an electron multiplier body in FIG. 1.
Figure 3:
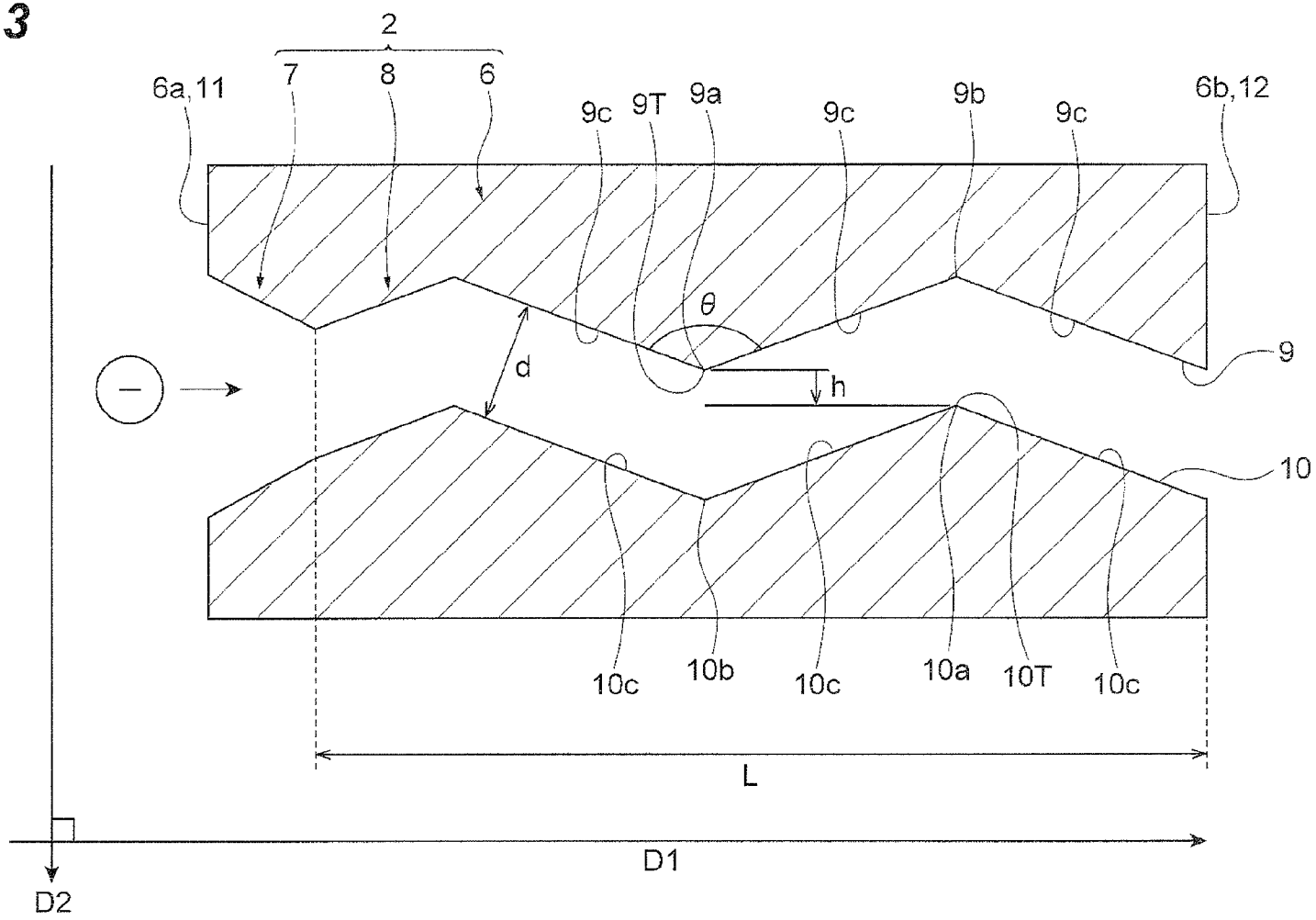
FIG. 3 is a cross-sectional view schematically illustrating the electron multiplier body illustrated in FIG. 2.

FIG. 1 is a cross-sectional view of a photomultiplier tube according to the embodiment, FIG. 2 is a perspective view of an electron multiplier body in FIG. 1, and FIG. 3 is a cross-sectional view schematically illustrating the electron multiplier body illustrated in FIG. 2. As illustrated in FIGS. 1 to 3, the photomultiplier tube 1 includes an electron multiplier body 2, a tube 3, a photocathode 4, and an anode 5.

The electron multiplier body 2 multiplies electrons by emitting secondary electrons according to the incidence of electrons. The electron multiplier body 2 includes a main body portion 6, an electron incidence portion 7, and a channel 8.

The main body portion 6 extends in a first direction D1. Further, the main body portion 6 is formed in a rectangular parallelepiped shape. The main body portion 6 includes one end surface 6*a* and the other end surface 6*b* in the first direction D1. At least a surface of the main body portion 6 is formed of an insulator. Here, for example, the main body portion 6 is formed of a ceramic which is an insulator. However, the main body portion 6 may be formed of a conductor such as metal and have an insulating film provided on a surface thereof.

The electron incidence portion 7 is an inlet portion for causing electrons to be incident from the outside of the main body portion 6 to the inside of the main body portion 6. The electron incidence portion 7 is provided in the main body portion 6 to be opened at the one end surface 6*a* of the main body portion 6 in the first direction D1. An opening of the electron incidence portion 7 at the one end surface 6*a* exhibits a rectangular shape when viewed from the first direction D1. Further, the electron incidence portion 7 is gradually narrowed in a second direction D2 to be described below, along the first direction D1. That is, the electron incidence portion 7 exhibits a truncated pyramid shape reduced along the first direction D1.

The channel 8 is a passage along which electrons travel inside the main body portion 6. The channel 8 emits secondary electrons according to electrons incident from the electron incidence portion 7. The channel 8 is opened at the other end surface 6*b* of the main body portion 6 in the first direction D1. The opening of the other end surface 6*b* of the channel 8 faces the anode 5. The channel 8 is provided in the main body portion 6 to reach the electron incidence portion 7.

The channel 8 includes a first inner surface 9 and a second inner surface 10 extending over the entire channel 8 in the first direction D1 and facing each other. The first inner surface 9 and the second inner surface 10 are spaced apart in the second direction D2 intersecting the first direction D1. The second direction D2 is a direction from the first inner surface 9 to the second inner surface 10. Here, the second direction D2 is a direction perpendicular to the first direction D1.

The first inner surface 9 includes a convex first bent portion 9*a* and a concave second bent portion 9*b* which are arranged alternately along the first direction D1. Further, the first inner surface 9 includes a plurality of first inclined surfaces 9*c* defining each of the first bent portion 9*a* and the second bent portion 9*b*. The first inclined surface 9*c* is formed in a planar shape. In this embodiment, the first bent portion 9*a* and the second bent portion 9*b* are bent in an angular shape.

The second inner surface 10 includes a convex third bent portion 10*a* and a concave fourth bent portion 10*b* which are arranged alternately along the first direction D1. Further, the second inner surface 10 includes a plurality of second inclined surfaces 10*c* defining each of the third bent portion 10*a* and the fourth bent portion 10*b*. The second inclined surface 10*c* is formed in a planar shape. In this embodiment, the third bent portion 10*a* and the fourth bent portion 10*b* are bent in an angular shape.

That is, the first inner surface 9 and the second inner surface 10 are formed to be repeatedly bent in a zigzag shape (for example, a wavy shape) along the first direction D1. Here, in the first inner surface 9 and the second inner surface 10, the first bent portion 9*a* and the fourth bent portion 10*b* face each other, the second bent portion 9*b* and the third bent portion 10*a* face each other, and the first inclined surfaces 9*c* and the second inclined surfaces 10*c* face each other in the second direction D2.

A resistive layer and a secondary electron multiplication layer are provided to be laminated on each other on the inner surfaces (at least the first inner surface 9 and the second inner surface 10) of the electron incidence portion 7 and the channel 8. Also, a surface layer of the electron incidence portion 7 and a surface layer of the channel 8 are the secondary electron multiplication layer. For example, a composite film of aluminum oxide ($Al_2O_3$) and zinc oxide (ZnO), a composite film of $Al_2O_3$ and titanium dioxide ($TiO_2$), or the like can be used as a material of the resistive layer. For example, $Al_2O_3$, magnesium oxide (MgO), or the like can be used as the material of the secondary electron multiplication layer. The resistive layer and the secondary electron multiplication layer can be formed using atomic layer deposition (ALD).

Further, metal layers 11 and 12 containing a nickel-based metal are respectively provided on the one end surface 6*a* and the other end surface 6*b* of the main body portion 6 using a method such as vapor deposition. A potential difference is applied to the main body portion 6 so that the metal layer 12 provided on the other end surface 6*b* has a higher potential than that of the metal layer 11 provided on the one end surface 6*a*. By the potential difference being applied in this way, a potential difference in the first direction D1 is generated in the channel 8.

The tube body 3 accommodates the electron multiplier body 2. As illustrated in FIG. 1, the tube body 3 extends in the first direction D1. In the first direction D1, one end 3*a* of the tube body 3 is open and the other end 3*b* is sealed. Here, the one end surface 6*a* of the main body portion 6 of the electron multiplier body 2 is located at the one end 3*a* of the tube body 3, and the other end surface 6*b* of the main body portion 6 of the electron multiplier body 2 is located at the other end 3*b* of the tube body 3.

The photocathode 4 generates photoelectrons according to the incidence of light. The photocathode 4 is formed in a flat plate shape. The photocathode 4 is provided to close the opening at the one end 3*a* of the tube body 3. The photocathode 4 faces the opening of the electron incidence portion 7 at the one end surface 6*a* of the main body portion 6 of the electron multiplier body 2. Accordingly, the photoelectrons generated at the photocathode 4 are supplied to the electron incidence portion 7. In a state in which the opening at the one end 3*a* of the tube body 3 is closed by the photocathode 4, the inside of the tube body 3 is reduced in pressure.

The anode 5 receives the secondary electrons which are emitted from the electron multiplier body 2. The anode 5 forms a flat plate shape. The anode 5 is arranged within the tube body 3 to face the opening of the channel 8 in the other end surface 6*b* of the main body portion 6. The anode 5 is arranged to be spaced apart from the other end surface 6*b* of the main body portion 6 and the other end 3*b* of the tube body 3. A detector (not illustrated) that detects pulses of an electrical signal corresponding to the secondary electrons received by the anode 5 is connected to the anode 5.

Here, as illustrated in FIG. 3, as one example, an interval h between a tip 9T of the first bent portion 9*a* and a tip 10T of the third bent portion 10*a* in the second direction D2 is substantially constant. As an example, a distance d between the first inclined surface 9*c* and the second inclined surface 10*c* facing each other is substantially constant. Further, as an example, an angle θ between a pair of first inclined surfaces 9*c* defining the first bent portion 9*a* is substantially constant. A length of the channel 8 in the first direction D1 is L.

The interval h, the distance d, the angle θ, and the length L satisfy Expressions (1) to (4) below.

[Expression 10]

$$-0.5 \leq h/d \leq 0.5 \quad (1)$$

[Expression 11]

$$96° \leq \theta \leq 172° \quad (2)$$

[Expression 12]

$$0.1 \text{ mm} \leq d \leq 10 \text{ mm} \quad (3)$$

[Expression 13]

$$4.0 \text{ mm} \leq L \leq 400 \text{ mm} \quad (4)$$

Next, an operation of the photomultiplier tube 1 will be described. First, when light is incident on the photocathode 4 from the outside of the photomultiplier tube 1, the photocathode 4 emits photoelectrons due to the photoelectric effect. The photoelectrons are incident on the electron incidence portion 7 of the electron multiplier body 2.

In this case, some of the photoelectrons collide with an inner surface of the electron incidence portion 7 according to directions in which the photoelectrons are emitted, and secondary electrons are emitted. The secondary electrons, and the photoelectrons not colliding with the inner surface of the electron incidence portion 7 pass through the electron incidence portion 7 and enter the channel 8. As described above, a potential difference is given in the first direction D1 inside the channel 8. After the electrons from the electron incidence portion 7 are incident on the channel 8, the electrons travel inside the channel 8 while being accelerated in the first direction D1 under the influence of the potential difference.

The electrons traveling inside the channel 8 collide with the first inclined surface 9*c* and the second inclined surface 10*c*, such that the secondary electrons are emitted. Here, the first inner surface 9 and the second inner surface 10 are formed to be repeatedly bent, as described above. Therefore, the electrons traveling in the first direction D1 repeatedly collide with the first inclined surface 9*c* and collide with the subsequent second inclined surface 10*c*.

The electrons multiplied in this way travel inside the channel 8, are output from the opening of the other end surface 6*b* of the main body portion 6, and are incident on the anode 5. The electrons incident on the anode 5 are detected by the detector as a pulsed electrical signal having a wave height according to the number of electrons.

Next, operations and effects obtained by respective values of the interval h, the distance d, the angle θ, and the length L satisfying Expressions (1) to (4) above will be described while showing results of a simulation.

Figure 4:
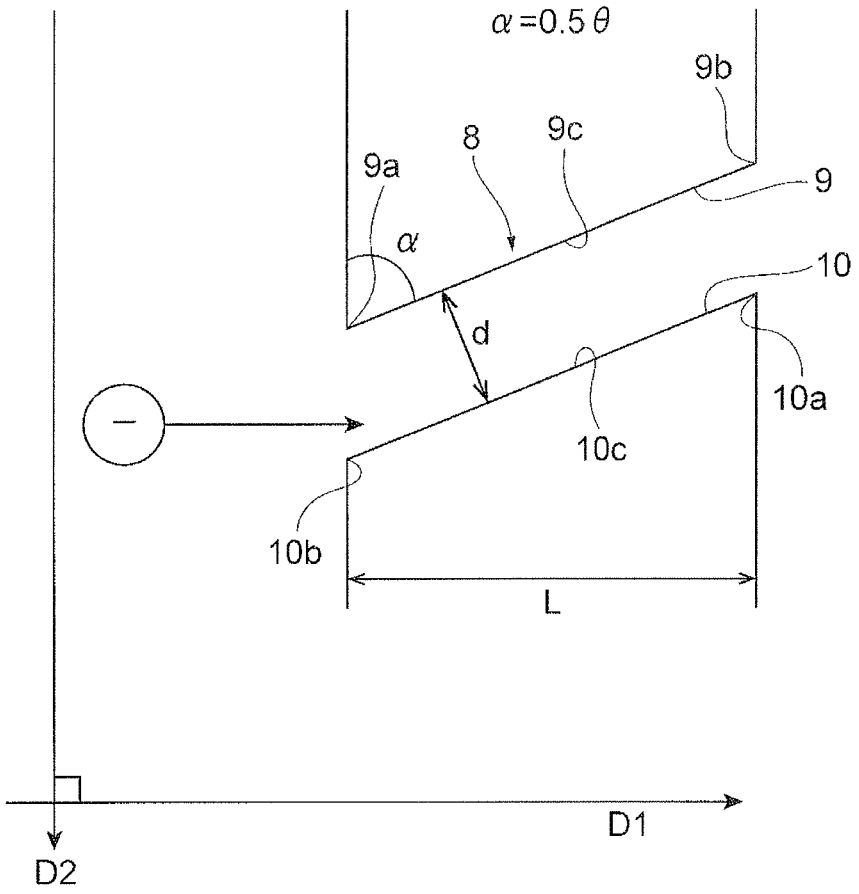
FIG. 4 is a diagram illustrating conditions of a simulation of obtaining a change in a gain based on a shape and a potential difference of a channel.
Figure 5:
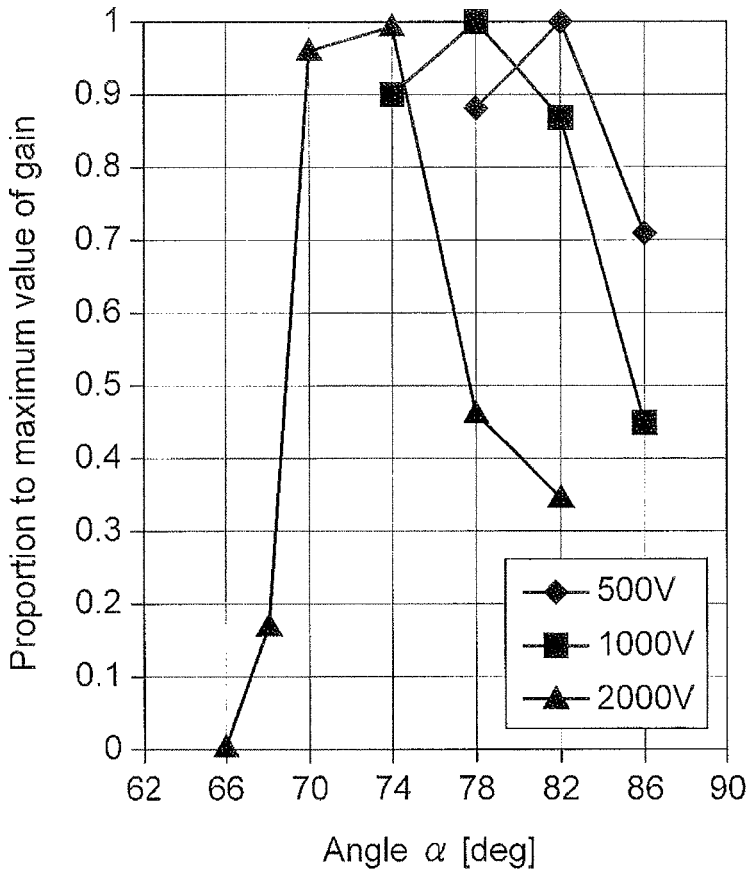
FIG. 5 is a graph illustrating results of the simulation of obtaining a change in a gain in conditions illustrated in FIG. 4.

FIG. 4 is a diagram illustrating conditions of a simulation of obtaining a change in the gain based on the shape and the potential difference of the channel, and FIG. 5 is a graph illustrating results of the simulation of obtaining a change in a gain in the conditions illustrated in FIG. 4. In this simulation, an angle θ suitable for improvement of electron multiplication efficiency is shown. As illustrated in FIG. 4, here, the simulation was performed using a model having a single first bent portion 9*a*, a single second bent portion 9*b*, and a single first inclined surface 9*c* in the first inner surface 9, and having a single third bent portion 10*a*, a single fourth bent portion 10*b*, and a single second inclined surface 10*c* in the second inner surface 10. In this model, the distance d between the first inclined surface 9*c* and the second inclined surface 10*c* was 0.5 mm, and the length L of the channel 8 was 20 mm. Further, a potential difference between both ends of the channel 8 in the first direction D1 was 500 V, 1000 V, and 2000 V. Also, the gain was obtained by changing the angle α (=0.5θ) of the first inclined surface 9*c*.

In FIG. 5, a horizontal axis indicates the angle α, and a vertical axis indicates a proportion to the maximum value of the gain. Respective plots show simulation results when the potential difference is 500 V, 1000 V, and 2000 V. In FIG. 5, it is shown that a high gain was obtained in a range of 70°≤α≤86°. Accordingly, it is shown that a relatively higher gain was obtained in the range of 140°≤θ≤172° in which the angle θ satisfies Expression (6) above.

Figure 6:
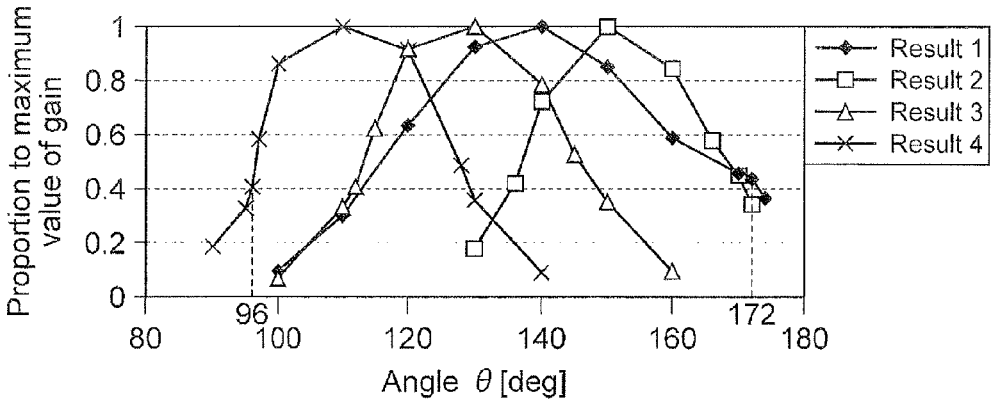
FIG. 6 is a graph illustrating results of a simulation of obtaining a change in a gain under a plurality of conditions.

FIG. 6 is a graph illustrating results of a simulation of obtaining a change in a gain under a plurality of conditions. In this simulation, an angle θ suitable for improvement of electron multiplication efficiency in each of condition 1, condition 2, condition 3, and condition 4 is shown.

In condition 1, the simulation was performed using the model having a single first bent portion 9*a*, a single second bent portion 9*b*, and a single first inclined surface 9*c* in the first inner surface 9, and having a single third bent portion 10*a*, a single fourth bent portion 10*b*, and a single second inclined surface 10*c* in the second inner surface 10, as illustrated in FIG. 4. In this model, $Al_2O_3$ was used as a material of the secondary electron multiplication layer, the distance d between the first inclined surface 9*c* and the second inclined surface 10*c* was 2.0 mm, and the length L of the channel 8 was 40 mm. Further, a potential difference between both ends of the channel 8 in the first direction D1 was 500 V. Also, the gain was obtained by changing the angle α (=0.5θ) of the first inclined surface 9*c* (Result 1 in FIG. 6).

In condition 2, the simulation was performed using a model having a plurality of first bent portions 9*a*, second bent portions 9*b*, and first inclined surfaces 9*c* in the first inner surface 9, and having a plurality of third bent portions 10*a*, fourth bent portions 10*b*, and second inclined surfaces 10*c* in the second inner surface 10, as illustrated in FIG. 3. In this model, $Al_2O_3$ was used as a material of the secondary electron multiplication layer, the distance d between the first inclined surface 9*c* and the second inclined surface 10*c* was 2.0 mm, the length L of the channel 8 was 40 mm, and the interval h between the tip 9T of the first bent portion 9*a* and the tip 10T of the third bent portion 10*a* in the second direction D2 was 0 mm. Further, a potential difference between both ends of the channel 8 in the first direction D1 was 500 V. Also, the gain was obtained by changing the angle θ of the first inclined surface 9*c* (Result 2 in FIG. 6).

In condition 3, the simulation was performed using the model having the plurality of first bent portions 9*a*, second bent portions 9*b*, and first inclined surfaces 9*c* in the first inner surface 9, and having the plurality of third bent portions 10*a*, fourth bent portions 10*b*, and second inclined surfaces 10*c* in the second inner surface 10, as illustrated in FIG. 3. In this model, $Al_2O_3$ was used as a material of the secondary electron multiplication layer, the distance d between the first inclined surface 9*c* and the second inclined surface 10*c* was 0.2 mm, the length L of the channel 8 was 4 mm, and the interval h between the tip 9T of the first bent portion 9*a* and the tip 10T of the third bent portion 10*a* in the second direction D2 was 0 mm. Further, a potential difference between both ends of the channel 8 in the first direction D1 was 1000 V. Also, the gain was obtained by changing the angle θ of the first inclined surface 9*c* (Result 3 in FIG. 6).

In condition 4, the simulation was performed using the model having the plurality of first bent portions 9*a*, second bent portions 9*b*, and first inclined surfaces 9*c* in the first inner surface 9, and having the plurality of third bent portions 10*a*, fourth bent portions 10*b*, and second inclined surfaces 10*c* in the second inner surface 10, as illustrated in FIG. 3. In this model, MgO was used as a material of the secondary electron multiplication layer, the distance d between the first inclined surface 9*c* and the second inclined surface 10*c* was 0.2 mm, the length L of the channel 8 was 4 mm, and the interval h between the tip 9T of the first bent portion 9*a* and the tip 10T of the third bent portion 10*a* in the second direction D2 was 0 mm. Further, a potential difference between both ends of the channel 8 in the first direction D1 was 1000 V. Also, the gain was obtained by changing the angle θ of the first inclined surface 9*c* (Result 4 in FIG. 6).

In FIG. 6, a horizontal axis indicates the angle θ, and a vertical axis indicates a proportion to the maximum value of the gain. Respective plots of FIG. 6 show simulation results (result 1, result 2, result 3, and result 4) in condition 1, condition 2, condition 3, and condition 4. Here, if the proportion to the maximum value of the gain is 0.4 or more, it is determined that a relatively higher gain is obtained. According to FIG. 6, it can be seen that a relatively higher gain is obtained in a range of $96° \leq \theta \leq 172°$ in which the angle θ satisfies Expression (2) above.

Figure 7:
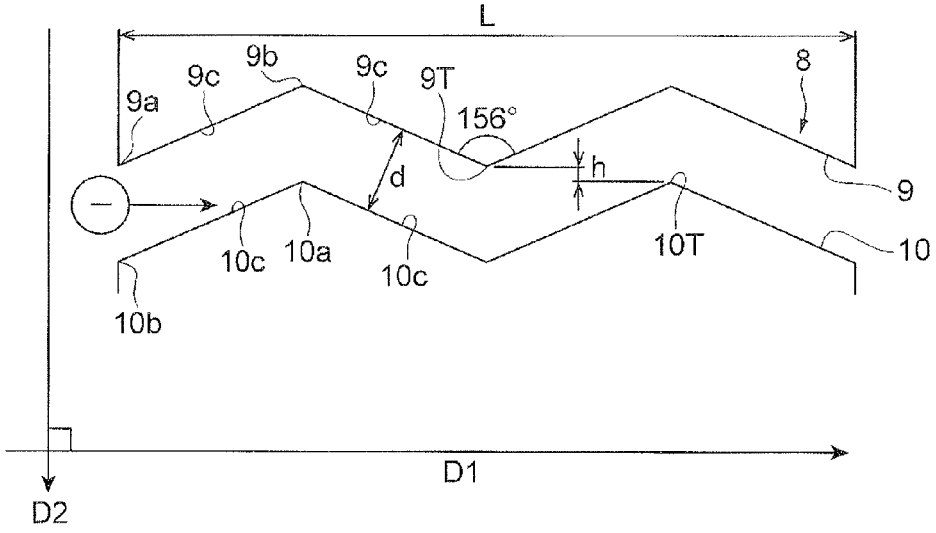
FIG. 7 is a diagram illustrating conditions of a simulation of obtaining a change in a gain based on a shape of a channel.
Figure 8:
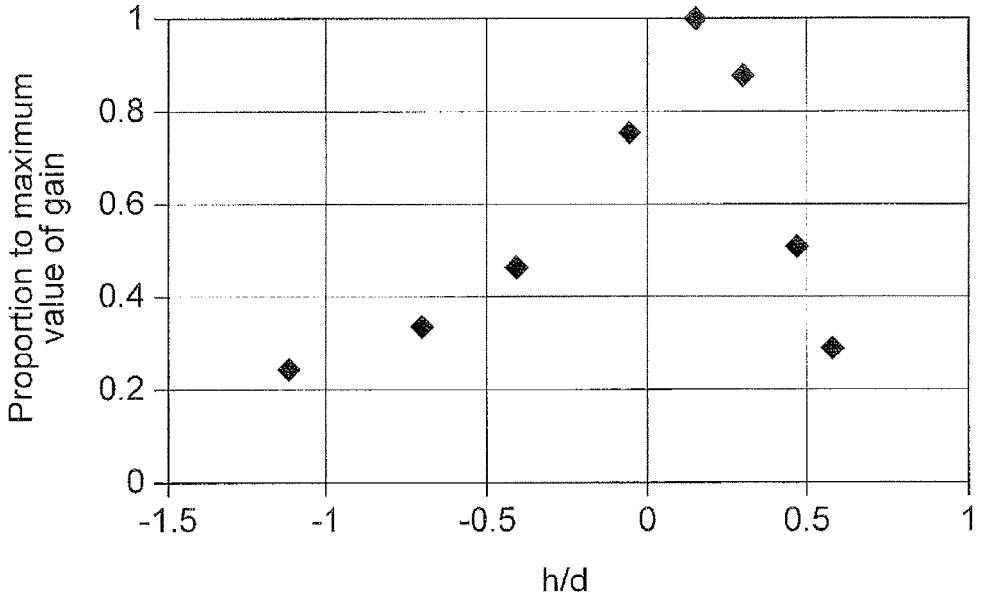
FIG. 8 is a graph illustrating results of the simulation of obtaining a change in a gain under conditions illustrated in FIG. 7.

FIG. 7 is a diagram illustrating conditions of a simulation of obtaining a change in the gain based on the shape of the channel, and FIG. 8 is a graph illustrating results of the simulation of obtaining a change in a gain under the conditions illustrated in FIG. 7. In this simulation, a ratio h/d of the interval h and the distance d suitable for improvement of electron multiplication efficiency is shown. As illustrated in FIG. 7, here, the simulation was performed using a model having three first bent portions 9*a*, two second bent portions 9*b*, and four first inclined surfaces 9*c* in the first inner surface 9, and having two third bent portions 10*a*, three fourth bent portions 10*b*, and four second inclined surfaces 10*c* in the second inner surface 10. In this model, the distance d between the first inclined surface 9*c* and the second inclined surface 10*c* was 0.5 mm, the length L of the channel 8 was 22 mm, and the angle θ of the first inclined surface 9*c* was 156°. Further, a potential difference between both ends of the channel 8 in the first direction D1 was 1000 V. Also, the gain was obtained by changing the ratio h/d of the interval h and the distance d.

In FIG. 8, a horizontal axis indicates the ratio h/d of the interval h and the distance d, and a vertical axis indicates a proportion to the maximum value of the gain. In FIG. 8, it is shown that a high gain was obtained in a range of $-0.5 \leq h/d \leq 0.5$. Accordingly, it is shown that a relatively higher gain was obtained when the ratio h/d of the interval h and the distance d satisfies Expression (1) above.

Figure 9A:
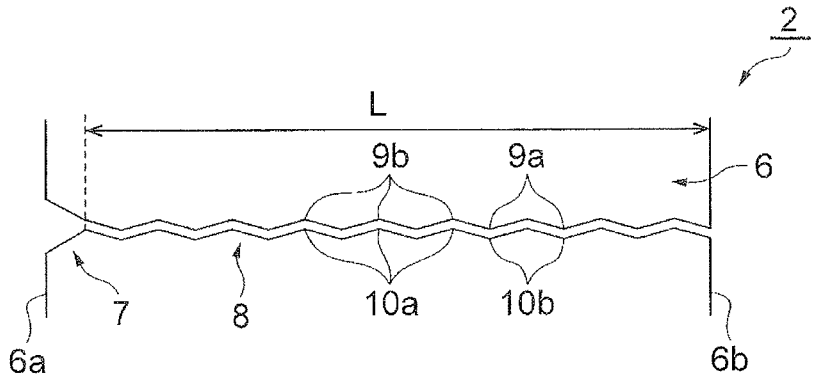
FIGS. 9A and 9B are diagrams illustrating conditions of a simulation of comparing gains in the embodiment and a comparative example.
Figure 9B:
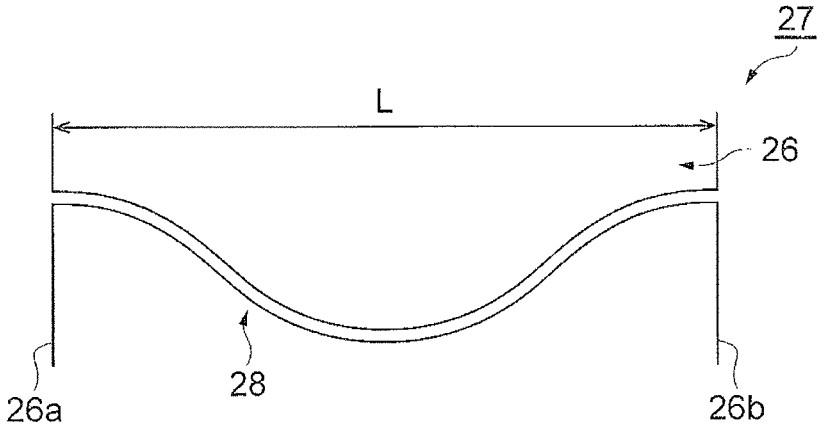
Figure 10:
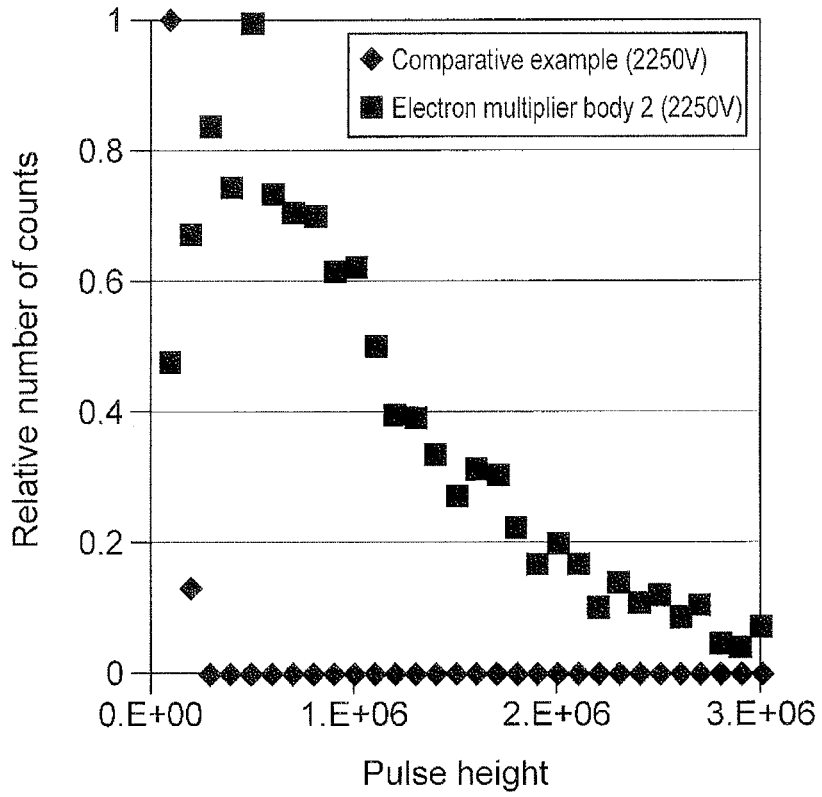
FIG. 10 is a graph illustrating results of the simulation of obtaining a gain under conditions illustrated in FIGS. 9A and 9B.

Here, respective gains of the electron multiplier body 2 according to the embodiment and an electron multiplier body 27 according to a comparative example will be described. FIGS. 9A and 9B are diagrams illustrating conditions of a simulation of comparing the gains of the embodiment and the comparative example, and FIG. 10 is a graph illustrating results of a simulation of obtaining the gain under the conditions illustrated in FIGS. 9A and 9B. As illustrated in FIGS. 9A and 9B, the length L of the channel 8 of the electron multiplier body 2 according to the embodiment and the length L of a channel 28 of the electron multiplier body 27 according to the comparative example were 45 mm. Further, a potential difference between both ends of the channels 8 and 28 in the first direction D1 was 2250 V. The channel 28 of the electron multiplier body 27 according to the comparative example exhibits a largely gently curved shape between one end surface 26*a* and the other end surface 26*b* of a main body portion 26. The channel 8 of the embodiment satisfies all of Expressions (1) to (4) above, whereas the channel 28 of the comparative example does not satisfy at least Expressions (1) to (3) above.

In FIG. 10, a horizontal axis indicates a pulse height, and a vertical axis indicates a relative number of counts. FIG. 10 illustrates pulse height distributions (PHDs) of the embodiment and the comparative example. Here, the relative number of counts is obtained by temporally integrating the number of counts of electrical signals having each pulse height and normalizing the number of counts, for the electrical signals detected at the anode 5. As illustrated in FIG. 10, the relative number of counts of the electron multiplier body 2 according to the embodiment is distributed in an area in which the gain is higher as compared to the relative number of counts of the electron multiplier body 27 according to the comparative example. Accordingly, it is shown that the electron multiplication efficiency of the electron multiplier body 2 according to the embodiment is relatively higher than that of the electron multiplier body 27 according to the comparative example. Further, in a plot of the electron multiplier body 2 according to the embodiment, a peak appears. Therefore, in the electron multiplier body 2, it is easy to distinguish between the noise and the signal and, as a result, it is possible to improve the accuracy of photon counting.

As described above, in the electron multiplier body 2 according to this embodiment, the first inner surface 9 of the channel 8 includes the convex first bent portion 9*a*, the concave second bent portion 9*b*, and the first inclined surface 9*c* defining the bent portions. The second inner surface 10 of the channel 8 includes the convex third bent portion 10*a*, the concave fourth bent portion 10*b*, and the second inclined surfaces 10*c* defining the bent portions. Also, the first bent portion 9*a* and the fourth bent portion 10*b* face each other, and the second bent portion 9*b* and the third bent portion 10*a* face each other. By the inner surfaces of the channel 8 having such a shape, the electrons traveling inside the channel 8 collide with a first inclined surface 9*c* or a second inclined surface 10*c*, such that the secondary electrons are emitted. The emitted secondary electrons travel to the downstream side in the first direction D1 of the channel 8, and further collide with a second inclined surface 10*c* or a first inclined surface 9*c*. Accordingly, secondary electrons are further emitted. In this case, since the respective values of the interval h, the distance d, the angle θ, and the length L defining the shape of the channel 8 satisfy Expressions (1) to (4) above, electron multiplication efficiency can be improved.

Further, the photomultiplier tube 1 according to this embodiment includes the electron multiplier body 2 described above. Therefore, it is possible to preferably achieve operations and effects by the electron multiplier body 2.

First Modification Example

Figure 11:
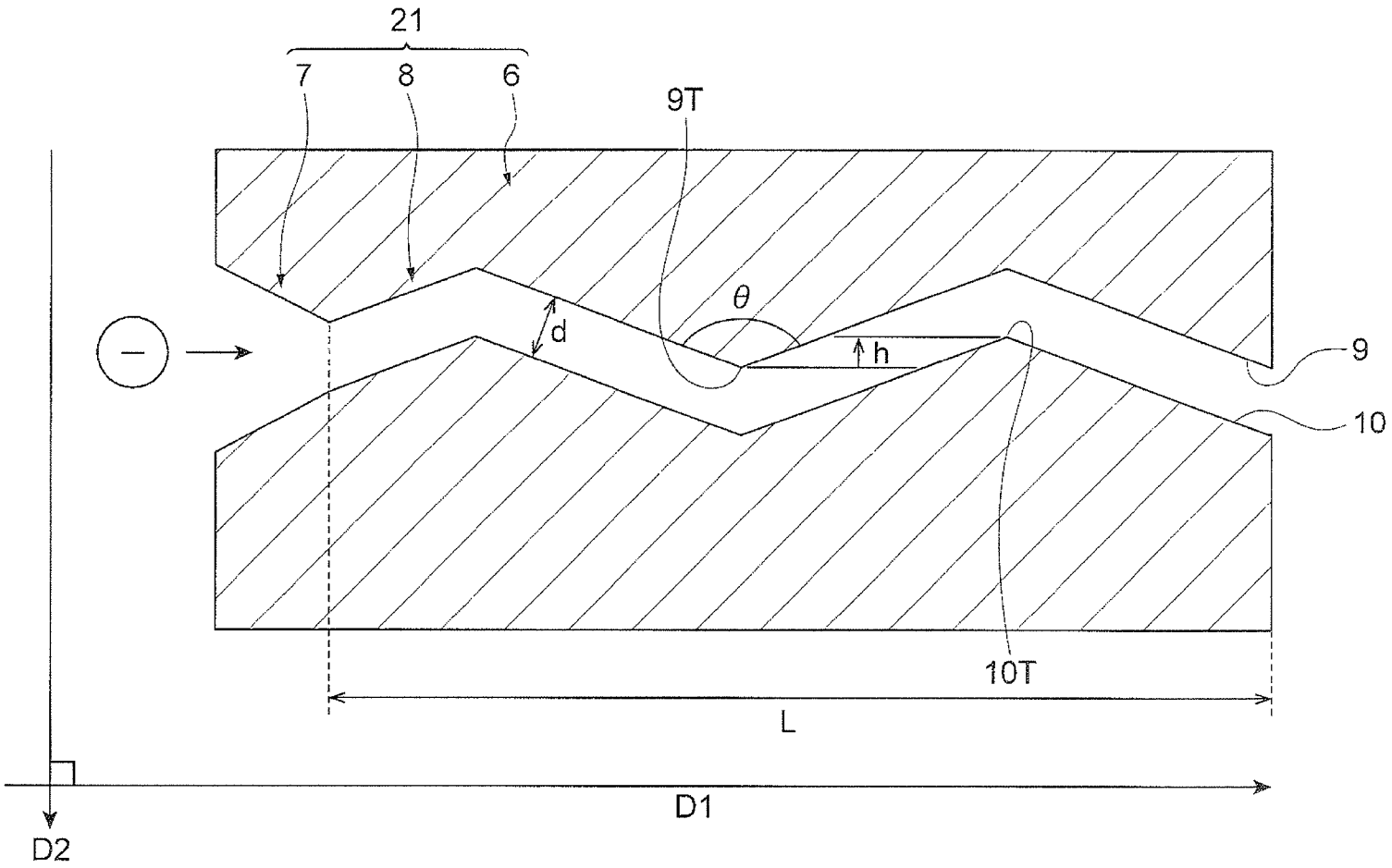
FIG. 11 is a cross-sectional view of an electron multiplier body according to a first modification example.

Next, a first modification example of the electron multiplier body 2 according to this embodiment will be described. FIG. 11 is a cross-sectional view of an electron multiplier body 21 according to the first modification example. As illustrated in FIG. 11, in the electron multiplier body 21 according to the first modification example, the ratio h/d of the interval h and the distance d further satisfies Expression (5) below. Specifically, in the electron multiplier body 21, the interval h has a negative value. Accordingly, in the electron multiplier body 21, a first inner surface 9 and a second inner surface 10 are arranged to overlap each other when viewed from a first direction D1.

[Expression 14]

$$h/d \leq 0 \quad (5)$$

Here, even when a pressure inside the channel 8 is reduced, there is residual gas in the channel 8. The residual gas causes ion feedback. That is, if electrons traveling inside the channel 8 collide with the residual gas, ions may be generated from the residual gas. The ions generated from the residual gas travel inside the channel 8 while being accelerated in a direction opposite to the first direction D1 under the influence of a potential difference in the channel 8. If the ions collide with the inner surface of the channel 8 or the like, unexpected electron emission may occur and noise may be generated in an output signal. On the other hand, it is possible to block a traveling path of the ions by adopting the above configuration. Therefore, it is possible to reduce an amount of electrons emitted by the ion feedback as described above. Therefore, it is possible to reduce the noise of the output signal.

Second Modification Example

Figure 12:
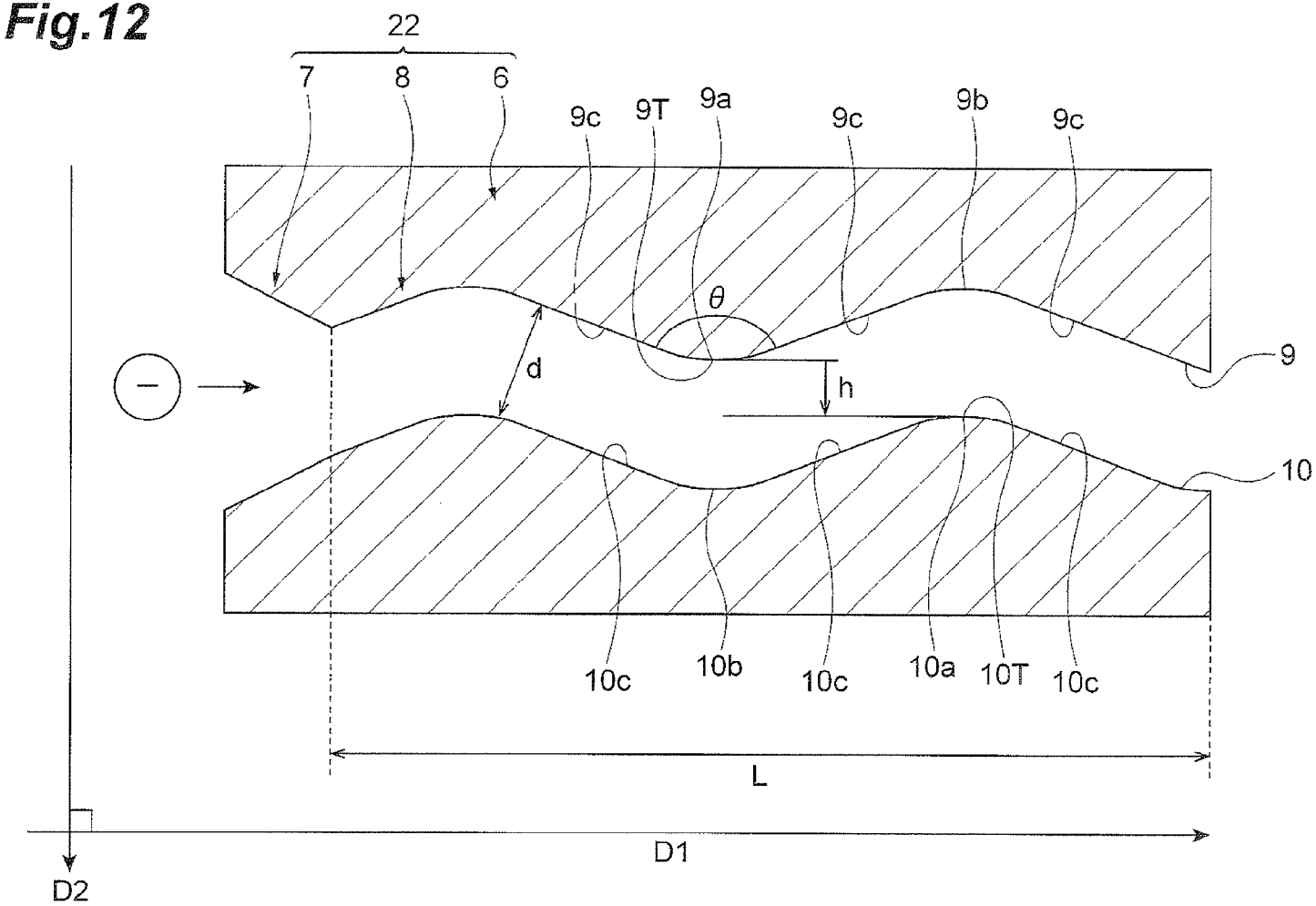
FIG. 12 is a cross-sectional view of an electron multiplier body according to a second modification example.

Next, a second modification example of the electron multiplier body 2 according to this embodiment will be described. FIG. 12 is a cross-sectional view of an electron multiplier body 22 according to a second modification example. As illustrated in FIG. 12, in the electron multiplier body 22 according to the second modification example, a first bent portion 9*a*, a second bent portion 9*b*, a third bent portion 10*a*, and a fourth bent portion 10*b* are not bent in an angular shape, and form a curved surface (that is, are chamfered). Specifically, the first bent portion 9*a* and the second bent portion 9*b* of the electron multiplier body 22 connect a pair of first inclined surfaces 9*c* in a curved surface. Further, the third bent portion 10*a* and the fourth bent portion 10*b* connect a pair of second inclined surfaces 10*c* in a curved surface. According to this configuration, it is possible to suppress the occurrence of a burr in the bent portion when the first to fourth bent portions 9*a* to 10*b* are formed. Further, even when the burr occurs when the first to fourth bent portions 9*a* to 10*b* are formed, the burr can be removed when the bent portion is processed in a curved shape. Therefore, it is possible to suppress electron emission and discharge which become noise caused by burrs of the first to fourth bent portions 9*a* to 10*b*. Accordingly, it is possible to reduce the noise of the output signal.

Third Modification Example

Figure 13:
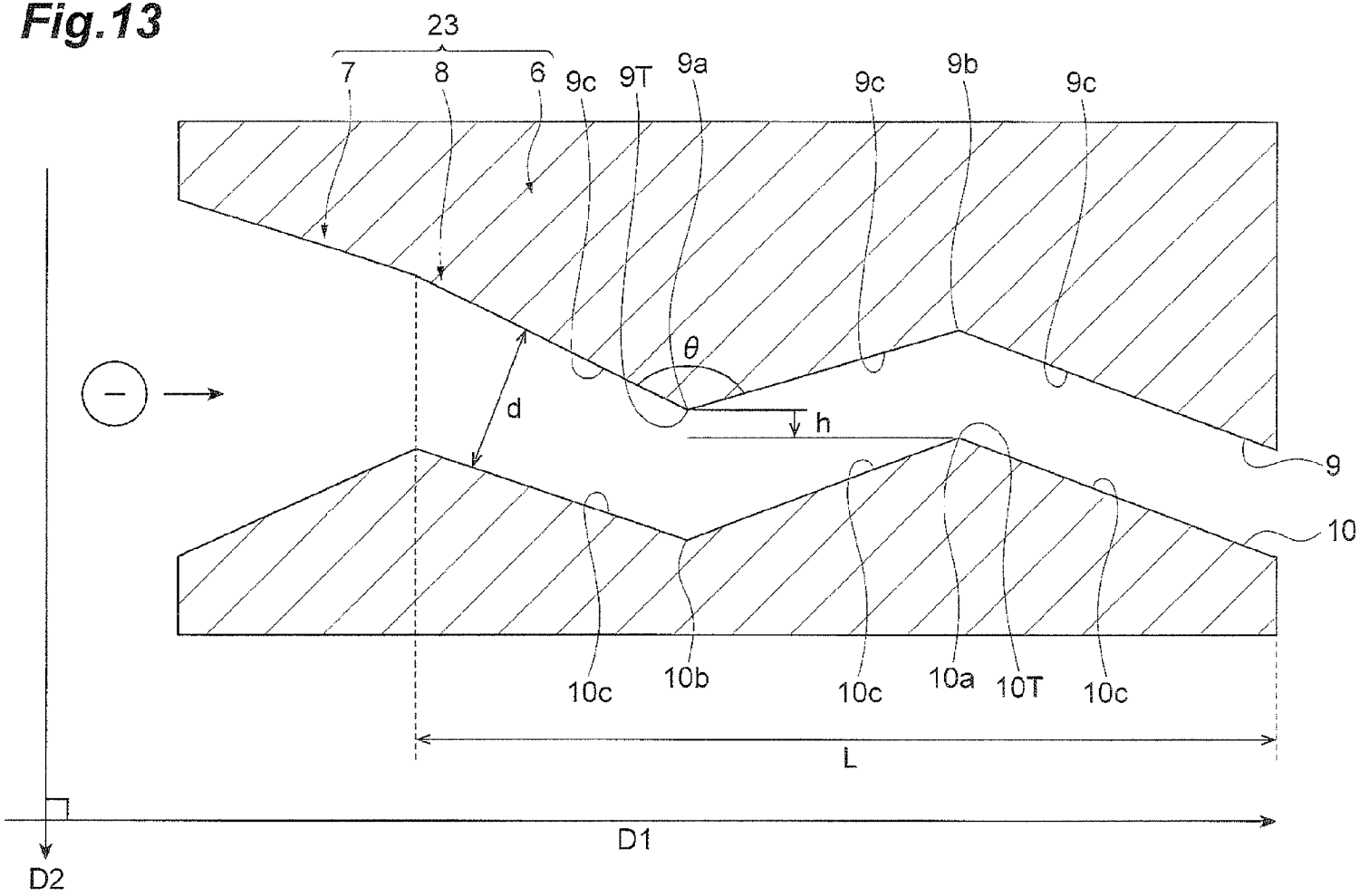
FIG. 13 is a cross-sectional view of an electron multiplier body according to a third modification example.

Next, a third modification example of the electron multiplier body 2 according to this embodiment will be described. FIG. 13 is a cross-sectional view of an electron multiplier body 23 according to the third modification example. As illustrated in FIG. 13, in the electron multiplier body 23 according to a third modification example, the distance d, the angle θ, and the interval h are not constant in each portion of the channel 8. Even when such a configuration is used, if the respective values of the interval h, the distance d, the angle θ, and the length L in each portion of the channel 8 satisfy Expressions (1) to (4), the electron multiplication efficiency can be improved.

The above embodiment is an embodiment of the electron multiplier body according to the present invention, and the photomultiplier tube 1 to which the electron multiplier body 2 has been applied has been described. Accordingly, the electron multiplier body according to the present invention is not intended to be applied only to the photomultiplier tube 1 described above.

Figure 14:
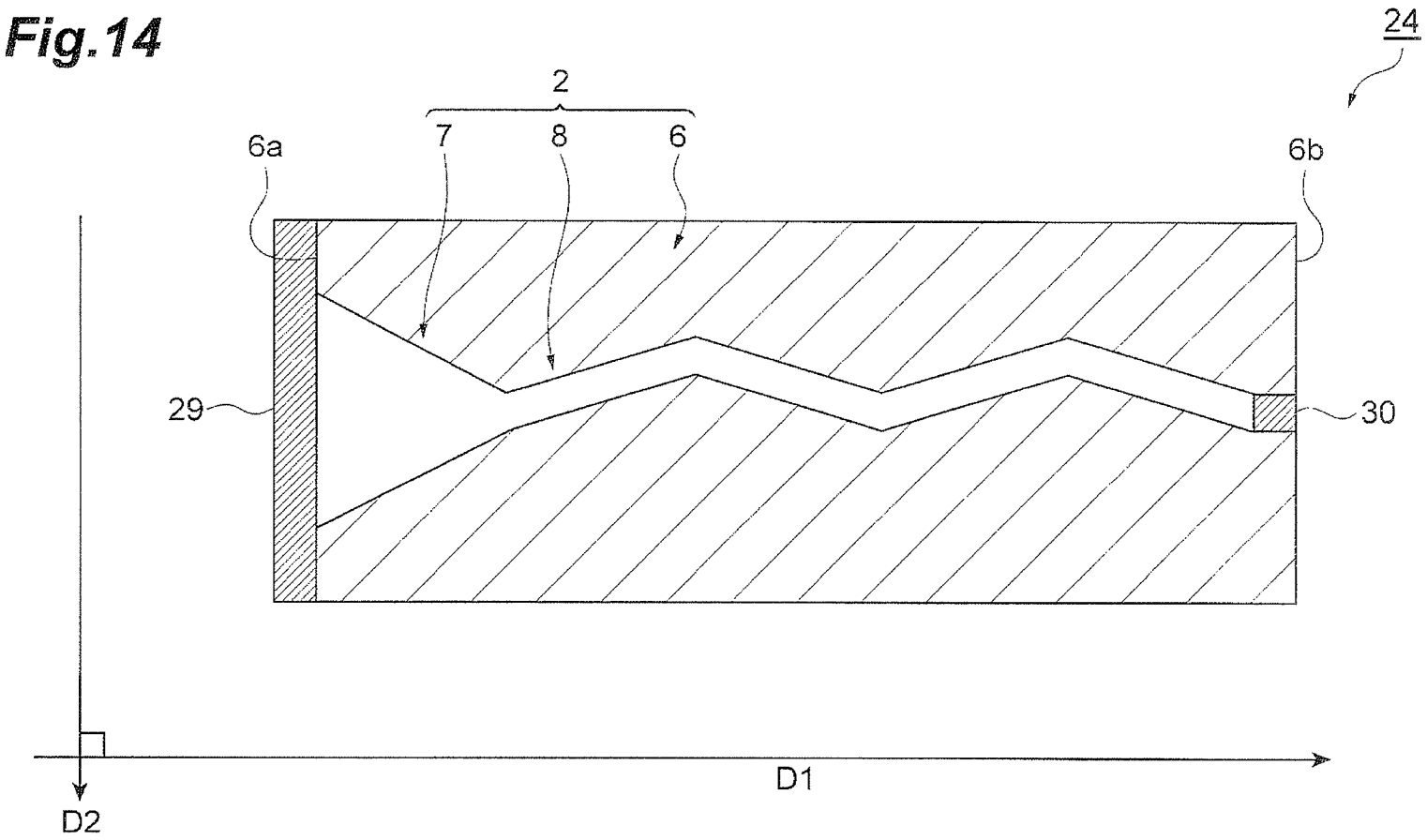
FIG. 14 is a cross-sectional view of a photomultiplier to which the electron multiplier body illustrated in FIG. 2 is applied.

For example, as illustrated in FIG. 14, the electron multiplier body 2 may become a photomultiplier 24 using a photocathode 29 and an anode 30. The photocathode 29 exhibits substantially the same shape as a contour of a main body portion 6 of the electron multiplier body 2 when viewed from a first direction D1. Further, the photocathode 29 is formed in a flat plate shape. The photocathode 29 is provided at one end surface 6*a* of the main body portion 6 to close an opening of an electron incidence portion 7 in the one end surface 6*a*. Accordingly, photoelectrons generated at the photocathode 29 are supplied to the electron incidence portion 7.

The anode 30 is provided inside the channel 8 to close the opening of the channel 8 in the other end surface 6*b* of the main body portion 6. Accordingly, the anode 30 receives secondary electrons travelling inside the channel 8 of the electron multiplier body 2 and reaching the other end surface 6*b*.

The photomultiplier 24 according to this embodiment includes the above-described electron multiplier body 2. Therefore, it is possible to preferably achieve operations and effects by the electron multiplier body 2.

What is claimed is:

1. An electron multiplier body, comprising:

a main body portion extending in a first direction;

an electron incidence portion provided in the main body portion to be opened at one end surface of the main body portion in the first direction, and on which electrons are incident from the outside of the main body portion; and a channel provided in the main body portion to be opened at the other end surface of the main body portion in the first direction and reach the electron incidence portion and configured to emit secondary electrons according to electrons incident from the electron incidence portion, wherein the channel includes a first inner surface and a second inner surface extending over the entire channel in the first direction and facing each other, the first inner surface includes a convex first bent portion and a concave second bent portion arranged alternately in the first direction, and a plurality of first inclined surfaces defining the first bent portion and the second bent portion, the second inner surface includes a convex third bent portion and a concave fourth bent portion arranged alternately in the first direction, and a plurality of second inclined surfaces defining the third bent portion and the fourth bent portion, the first bent portion and the fourth bent portion are arranged to face each other in a second direction directed from the first inner surface to the second inner surface, the second bent portion and the third bent portion are arranged to face each other in the second direction, and when an interval between a tip of the first bent portion and a tip of the third bent portion in the second direction is h, a distance between the first inclined surface and the second inclined surfaces facing each other is d, an angle between a pair of first inclined surfaces defining the first bent portion is θ, and a length of the channel in the first direction is L, Expressions (1) to (4) below are satisfied

[Expression 1]

$$-0.5 \leq h/d \leq 0.5 \quad (1)$$

[Expression 2]

$$96° \leq \theta \leq 172° \quad (2)$$

[Expression 3]

$$0.1 \text{ mm} \leq d \leq 10 \text{ mm} \quad (3)$$

[Expression 4]

$$4.0 \text{ mm} \leq L \leq 400 \text{ mm} \quad (4).$$

2. The electron multiplier body according to claim 1, wherein Expression (5) below is further satisfied

[Expression 5]

$$h/d \leq 0 \quad (5).$$

3. The electron multiplier body according to claim 1, wherein each of the first bent portion and the second bent portion connects a pair of first inclined surfaces in a curved surface, and each of the third bent portion and the fourth bent portion connects a pair of second inclined surfaces in a curved surface.

4. A photomultiplier tube, comprising:

the electron multiplier body according to claim 1;

a tube body accommodating the electron multiplier body;

a photocathode provided in the tube body to face an opening of the electron incidence portion in the one end surface, and supplies photoelectrons to the electron incidence portion; and an anode arranged in the tube body to face the opening of the channel in the other end surface, and receives the secondary electrons.

5. A photomultiplier, comprising:

the electron multiplier body according to claim 1;

a photocathode provided to close an opening of the electron incidence portion in the one end surface, and supplies photoelectrons to the electron incidence portion; and an anode provided to close the opening of the channel in the other end surface, and receives the secondary electrons.

* * * * *